United States Patent [19]

Deyoung

[11] Patent Number: 4,486,059

[45] Date of Patent: Dec. 4, 1984

[54] RECEPTACLE ASSEMBLY

[75] Inventor: David M. Deyoung, Bloomington, Minn.

[73] Assignee: Magnetic Controls Company, Minneapolis, Minn.

[21] Appl. No.: 420,133

[22] Filed: Sep. 20, 1982

[51] Int. Cl.[3] ..... H01R 4/66

[52] U.S. Cl. ..... 339/14 R; 339/176 MP

[58] Field of Search ..... 339/14 R, 17 C, 182 R, 339/186 M, 176 MP, 176 M, 14 P

[56] References Cited

U.S. PATENT DOCUMENTS 4,070,084 1/1978 Hutchison ..... 339/176 M X 4,202,593 5/1980 Abernethy et al. ..... 339/176 M X

FOREIGN PATENT DOCUMENTS 2733634 2/1979 Fed. Rep. of Germany .... 339/14 R

*Primary Examiner*—Eugene F. Desmond

*Attorney, Agent, or Firm*—Dorsey & Whitney

[57] ABSTRACT

A right angle receptacle assembly adapted for connection with a printed circuit board and having a plurality of elongated contact members extending generally parallel to the surface of the printed circuit board. The receptacle also includes a contact lug connected with each contact member for electrically connecting such member to a circuit on the printed circuit board. This contact lug absorbs torsional force caused by insertion and withdrawal of a mating plug and includes first and second leg portions and an intermediate leg portion joining the first and second leg portions in a laterally off-set position with respect to one another.

8 Claims, 7 Drawing Figures

RECEPTACLE ASSEMBLY

BACKGROUND OF THE INVENTION

The present invention relates generally to a receptacle assembly, and more particularly to a right angle receptacle assembly adapted for connection with a printed circuit board or the like.

It is common in the prior art to connect various types of receptacle assemblies such as audio receptacles and the like to a base such as a printed circuit board. When this is done, a plurality of electrical contacts extend from the receptacle through the printed circuit board where they are connected with leads on the printed circuit board by means such as soldering. Many of these receptacle assemblies which are adapted for direct connection to printed circuit boards are what are referred to in the prior art as straight backed receptacles. These receptacles provide plug access in a direction generally perpendicular to the plane of the printed circuit board. Thus, the plug is inserted into and withdrawn from the mounted receptacle in a direction generally perpendicular to the printed circuit board.

Another general type of receptacle assembly which is mounted directly to printed circuit boards and the like is referred to as a right angle receptacle assembly. In a right angle receptacle, the plug element is inserted into and withdrawn from the receptacle in a direction generally parallel to the surface of the printed circuit board. Because of this construction, torsional forces are exerted on the receptacle whenever a plug is inserted or withdrawn. In most prior art right angle receptacles, these torsional forces are transferred directly to the electrical contacts or lugs which are retained by soldering with respect to the printed circuit board. Over the course of extended use, stresses are built up in the soldered joint retaining the contact lug to the printed circuit board. This increases the chance that the soldered joint will break away from the printed circuit board and cause an inadvertent malfunction of the receptacle such as an intermittent electrical connection.

Accordingly, there is a need in the art for a right angle receptacle of the type adapted for connection with a printed circuit board or the like which minimizes or eliminates stress on the soldered contact joint resulting from insertion and withdrawal of the plug with respect to the receptacle.

SUMMARY OF THE INVENTION

The present invention relates to a right angle receptacle assembly adapted for connection with a printed circuit board or the like and overcomes the problems existing in the prior art by providing floating contact lugs which absorb the torsional forces caused by insertion and withdrawal of the plug relative to receptacle assembly. The structure of the present invention thus prevents the limited rotational or rocking movement and the torsional forces caused by insertion and withdrawal of the plug from being transferred to the soldered joint on the printed circuit board.

The specific construction of the receptacle assembly of the present invention includes a non-conductive housing member with a base portion adapted for connection with a printed circuit board. A plurality of elongated contact members extend within the housing and parallel to the surface of the printed circuit board. Each of these contact members includes a forward end for electrical engagement with corresponding contacts in a mating plug and a rearward end adapted for connection with a contact lug which ultimately is connected with the printed circuit board by a soldered joint. The structure of the present invention includes an improved configuration of a contact lug for extending between a rearward portion of the elongated contact member and the printed circuit board. Specifically, the improved contact element plug includes a first leg member disposed generally perpendicular to the printed circuit board for connection with a rearward portion of the contact member, a second leg member spaced laterally with respect to the first leg member and which is also disposed generally perpendicular to the printed circuit board and which extends downwardly for connection with the printed circuit board by a soldered joint and an intermediate, generally laterally extending portion joining the first and second legs of the contact lug. With this structure, slight rotational or rocking movement of the receptacle assembly or a torsional force acting on the first leg member of the contact lug as a result of insertion and withdrawal of the plug member is absorbed by the contact lug and is prevented from being transferred to the soldered joint.

Accordingly, it is an object of the present invention to provide an improved right angle receptacle assembly, and particularly a receptacle adapted for use with an audio plug, for connection with a printed circuit board.

Another object of the present invention is to provide a right angle receptacle assembly in which the torsional forces on the contact elements of the receptacle resulting from insertion and withdrawal of a mating plug are absorbed and prevented from being transferred to the soldered joint on the printed circuit board.

A further object of the present invention is to provide a right angle receptacle assembly of the type described above with an improved contact lug which absorbs the afore-mentioned torsional forces and prevents the same from being transferred to the soldered joint on the printed circuit board.

These and other objects of the present invention will become apparent with reference to the drawings, the description of the preferred embodiment and the appended claims.

DESCRIPTION OF THE PREFERRED EMBODIMENT

Figure 1:
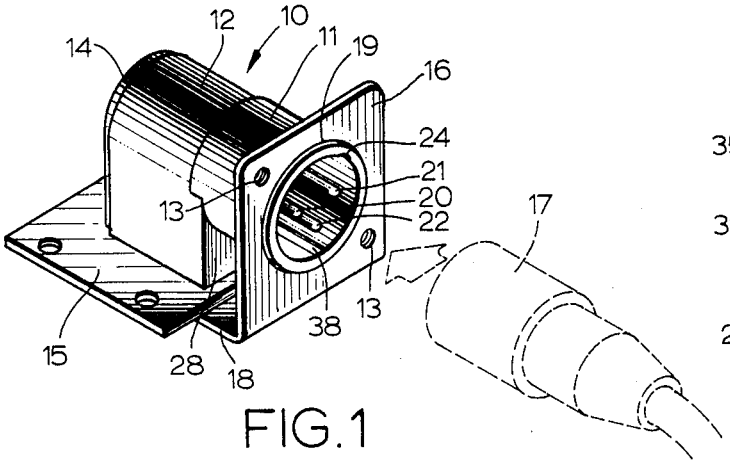
FIG. 1 is a pictorial view of the receptacle assembly of the present invention showing its connection to a portion of the printed circuit board and to a mounting bracket and also showing a mating plug in phantom.

As illustrated in FIG. 1, the receptacle assembly of the present invention includes an insulative receptacle housing 10 having a forward, generally hollow cylindrical portion 11 and a rearward portion 12. As will be described in greater detail below, the housing 10 is adapted for connection with a printed circuit board 15 by appropriate connection means. A generally L-shaped mounting bracket having a bottom portion 18 and a front face portion 16 is connected with the printed circuit board 15 so as to facilitate the mounting of a front panel (not shown) with respect to the forward end of the housing 11. A pair of threaded openings 13 are provided in the face portion 16 for this purpose. The forward face portion 16 of the mounting bracket includes a circular opening 19 through which the forward end 11 of the housing 10 extends. The forward end 11 includes a forward opening to provide connecting access to a mating plug member which is illustrated in phantom in FIG. 1 by the reference numeral 17. The rearward end of the housing 10 includes a cover portion 14 which is sonically welded to the end of the rearward portion 12 following assembly of the receptacle.

Figure 2:
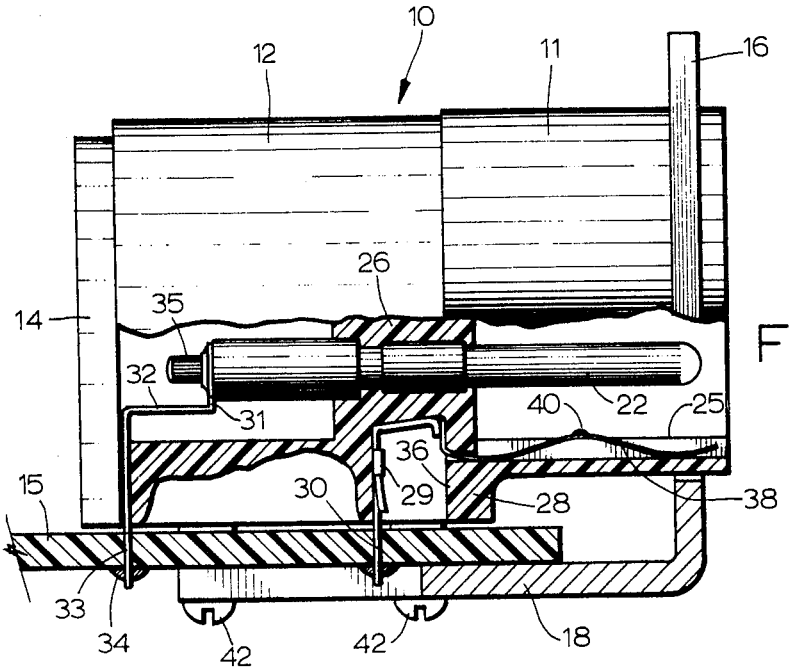
FIG. 2 is a side elevational view, partially in section, of the receptacle assembly of the present invention connected with a printed circuit board.

With reference to FIGS. 1 and 2, it can be seen that the receptacle includes a plurality of elongated, relatively rigid contact members 20, 21 and 22 extending longitudinally through the housing 10. The housing 10 includes a central, solid portion 26 separating the forward end 11 from the rearward end 12 and functions to support and retain the members 20, 21 and 22 in a fixed position with respect to the housing 10. In the preferred embodiment, the contact members 20, 21 and 22 are retained within the central portion 26 in a press fit relationship. The rearward portions of the contact members 20, 21 and 22 extend rearwardly of the central portion 26 for connection with a first leg 31 of a contact lug.

The forward end 11 of the housing 10 is generally cylindrically shaped and is hollow to receive a conventional mating plug member 17 which includes openings to mate with the male contact elements 20, 21 and 22. The inside surface of the forward end 11 is provided with a groove 24 to mate with a corresponding rib on the plug member 17 to insure proper alignment. The inside surface of the forward end 11 also includes a groove 25 for retaining and positioning a ground spring 38. When the plug 17 is inserted into the forward end 11, an exterior sleeve portion of the plug 17 engages a contact point 40 (FIG. 2) on the ground spring 38.

Figure 4:
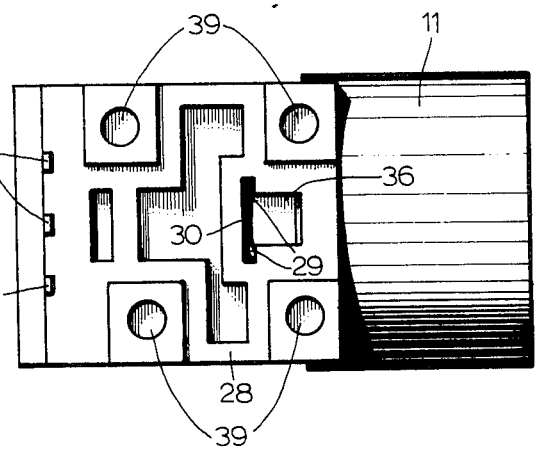
FIG. 4 is a bottom elevational view of the receptacle assembly of the present invention.

The housing also includes a base portion 28 best illustrated in FIGS. 2 and 4. The base 28 provides support for the main housing portions 11 and 12 and includes a relatively flat bottom for engagement with the top surface of the printed circuit board 15. The base 28 is provided with four openings 39 to receive a plurality of threaded members 42 for the purpose of securing the housing 10 to the circuit board 15. As shown in FIG. 2, the threaded members 42 also function to secure the mounting bracket to the printed circuit board 15.

The base portion 28 also includes a forwardly positioned opening 36 which houses a ground lug 30. As shown best in FIG. 2, the ground lug 30 includes an upper portion disposed within an opening 36 and a plurality of barbs 29 adapted for insertion into portions of the opening 36 to retain the ground lug 30 in an operative position. The lower end of the ground lug 30 extends downwardly from the base through the circuit board and is soldered in that position by a conventional soldering joint to the printed circuit board. An upper end of the ground lug 30 is bent downwardly at its forward end to electrically engage a rearward portion of the ground spring 38. The ground spring 38 comprises an elongated member which lies in the groove 25 on the interior surface of the forward portion 11. The rearward end of the ground spring 38 extends through a portion of the intermediate section 26 of the housing 10 and is bent upwardly to electrically engage the forwardly disposed and downwardly extending portion of the ground lug 30.

The rearward end of the base portion 28 includes three small openings to permit the second leg portions 33 of the contact lugs corresponding to the contact members 20, 21 and 22 to extend downwardly through the base 28 and thus also to the printed circuit board 15. Each of the second leg portions 33 is then retained with respect to the printed circuit board by a conventional solder joint 34.

Figure 3:
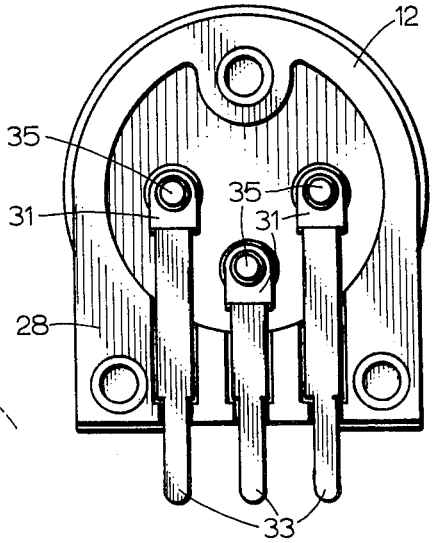
FIG. 3 is a rearward end elevational view of the receptacle assembly of the present invention with the rearward cover removed.
Figure 5:
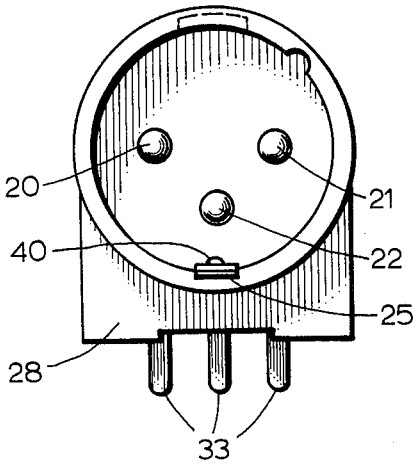
FIG. 5 is a front end elevational view of the receptacle assembly of the present invention.
Figure 6:
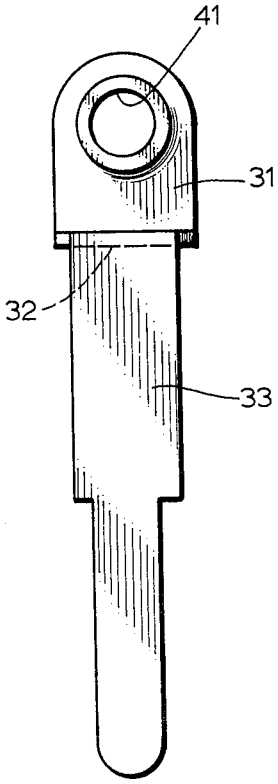
FIG. 6 is a rear elevational view of the improved contact lug of the present invention.
Figure 7:
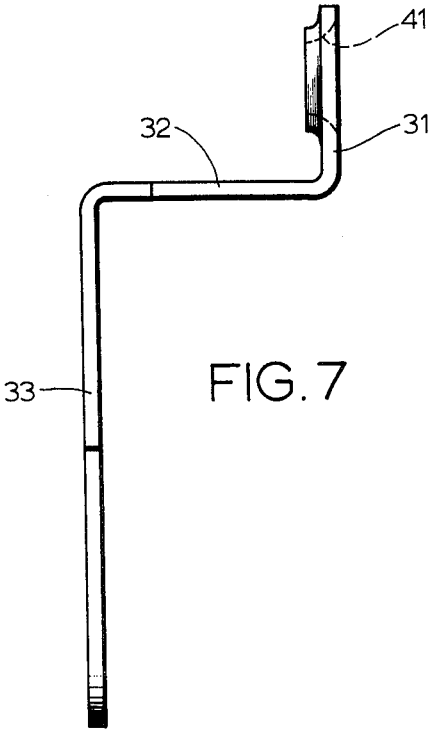
FIG. 7 is a side elevational view of the improved contact lug of the present invention.

General reference is next made to FIGS. 2 and 3 and specific reference to FIGS. 5 and 6 showing the detailed configuration of the contact lugs which function to electrically connect the contact members 20, 21 and 22 (FIG. 1) with a circuit on the printed circuit board 15. Each contact lug includes a first leg portion 31 which, when assembled, extends generally perpendicular to the surface of the printed circuit board 15 and generally perpendicular to its respective elongated contact member 20, 21 or 22. This first leg portion 31 includes an opening 41 which is retained with respect to the rearward end of its respective contact member 20, 21 and 22 by press-fitting the opening 41 over the splined end portion 35. Each of the contact lugs also includes a second leg portion 33 also disposed generally perpendicular to the surface of the printed circuit board and extending downwardly through the lower base section 28 of the housing 10 and through the printed circuit board 15 as illustrated in FIG. 2. At this point, the lower end of the second leg portion 33 is retained with respect to the printed circuit board by a conventional solder joint 34. Each of the contact lugs also includes an intermediate, generally laterally extending intermediate leg portion 32 joining the first and second leg portions 31 and 33 such that the first and second leg portions are laterally off-set from one another. In this context, the term laterally means in a direction generally parallel to the surface of the printed circuit board 15. In the preferred embodiment, the intermediate section 32 is at right angles with respect to both the first leg portion 31 and the second leg portion 33, however, it is contemplated that the advantages and features of the present invention can also be utilized if the intermediate section 32 is not at right angles with respect to these two leg portions, but at some other angle with respect to them. An important feature, however, is that the intermediate portion 32 join the first and second leg portions 31 and 33 so that these first and second leg portions are laterally off-set from one another. It has been found that this particular construction absorbs the slight rocking or other movement of the housing 10 and contact members 20, 21 and 22 and also the torsional forces generated on the first leg portion 31 as a result of repeated insertions and withdrawals of the plug member 17 (FIG. 1) with respect to the receptacle.

In the preferred embodiment, the contact members 20, 21 and 22 are male members although it is contemplated that they could be female members as well. Also, although the present invention is particularly suitable as an audio receptacle for an audio plug, other uses are also contemplated. Thus, although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

I claim:

1. A receptacle assembly adapted for mounting onto a printed circuit board or the like, said receptacle assembly comprising:

a housing having a forward opening for receiving a mating plug, a base portion for connection with the printed circuit board, a rearward recessed portion and a mounting portion disposed between said forward opening and said rearward recessed portion;

at least one elongated contact member rigidly supported between its ends by said mounting portion and disposed within said housing, the longitudinal axis of said contact member lying in a plane generally parallel to the mounting surface of the printed circuit board, the forward end of said contact member being accessible to the mating plug through said forward opening and the rearward end of said contact member extending into said rearward recessed portion;

a lug opening extending generally perpendicular to said base portion and into said rearward recessed portion; and a contact lug connected with said elongated contact member for electrically connecting said contact member with a contact joint associated with the printed circuit board, said contact lug including a first leg portion connected with a rearward portion of said elongated contact member, a second leg portion connected with the contact joint of the printed circuit board and extending through said lug opening and generally perpendicular to the mounting surface of the printed circuit board, and an intermediate leg portion joining said first and second leg portions so that said first and second leg portions are laterally offset from one another, said contact lug being disposed within said rearward recessed portion and said lug opening being larger than the cross-sectional configuration of that portion of said second leg portion extending therethrough thereby permitting limited relative movement between said housing and said contact joint.

2. The receptacle assembly of claim 1 wherein said first leg portion is generally perpendicular to the mounting surface of the printed circuit board.

3. The receptacle assembly of claim 2 wherein said intermediate leg portion is joined with said first and second leg portions at approximately right angles.

4. The receptacle assembly of claim 3 having three elongated contact members and a contact lug connected with each of said contact members.

5. The receptacle assembly of claim 1 comprising a right angle receptacle wherein said housing includes a forwardly extending cylindrical portion embodying said forward opening, said forwardly extending cylindrical portion having a longitudinal axis generally parallel to the mounting surface of the base.

6. The receptacle assembly of claim 5 wherein said elongated contact member is a male member adapted for receipt by a corresponding female contact member in the mating plug.

7. The receptacle assembly of claim 5 including a ground contact member disposed on the inner cylindrical surface of said forwardly extending cylindrical portion.

8. The receptacle assembly of claim 7 including a ground lug electrically connected with said ground contact member and adapted for connection with an electrical circuit on the printed circuit board.

* * * * *